United States Patent [19]

Schulze et al.

[11] Patent Number: 4,709,859

[45] Date of Patent: Dec. 1, 1987

[54] HIGH PRESSURE WASHING APPARATUS

[75] Inventors: Werner Schulze, Winnenden-Höfen; Josef Gerich, Winnenden, both of Fed. Rep. of Germany

[73] Assignee: Alfred Karcher GmbH & Co., Winnenden, Fed. Rep. of Germany

[21] Appl. No.: 705,066

[22] Filed: Feb. 25, 1985

[30] Foreign Application Priority Data

Mar. 2, 1984 [DE] Fed. Rep. of Germany ..... 3407744

[51] Int. Cl.[4] ..... B05B 9/01

[52] U.S. Cl. ..... 239/525; 285/281; 239/600

[58] Field of Search ..... 239/525, 526, 527, 530, 239/528, 600; 285/276, 278, 98, 281, 115

[56] References Cited

U.S. PATENT DOCUMENTS

| | | | |
|---|---|---|---|
| 1,849,427 | 3/1932 | Hook | 285/115 X |
| 2,295,830 | 9/1942 | Carlson | 285/115 |
| 2,356,865 | 8/1944 | Mason | 239/527 X |
| 2,535,310 | 8/1945 | Matteson | 239/526 X |
| 2,677,416 | 5/1954 | Smith | 285/281 X |
| 2,712,457 | 7/1955 | Kimho | 285/278 |
| 2,745,682 | 5/1956 | Chevallier | 285/276 X |
| 2,795,460 | 6/1957 | Bletcher et al. | 239/530 X |
| 3,372,948 | 3/1968 | Arneson | 285/98 |
| 3,799,589 | 3/1974 | Boelkins | 285/281 |
| 4,286,734 | 9/1981 | Tonge | 239/526 X |
| 4,500,119 | 2/1985 | Geberth | 285/281 X |
| 4,541,568 | 9/1985 | Lichfield | 239/526 X |

FOREIGN PATENT DOCUMENTS

| | | | |
|---|---|---|---|
| 2846755 | 9/1980 | Fed. Rep. of Germany . | |
| 3226571 | 5/1984 | Fed. Rep. of Germany . | |
| 2331740 | 6/1977 | France | 285/281 |
| 2067923 | 9/1981 | United Kingdom . | |

*Primary Examiner*—Andres Kashnikow
*Assistant Examiner*—Kevin Patrick Weldon
*Attorney, Agent, or Firm*—Wolf, Greenfield & Sacks

[57] ABSTRACT

In a high pressure washing apparatus with a spray handle and a flexible hose leading to it, in order to create the possibility of rotation between the hose and the spray handle, it is proposed that the spray handle should display a barrel, for connecting to the hose, into which can be inserted in sealed fashion a hose nipple connected to the hose end, that a bearing surface be provided on the spray handle, against which rests a flange connected with the hose nipple, and thereby preventing the hose nipple from being pulled from the barrel, and that the bearing surface and/or the hose nipple flange surround the hose nipple in ring form, and be rotatable with respect to one another around the longitudinal axis of the hose nipple.

8 Claims, 2 Drawing Figures

HIGH PRESSURE WASHING APPARATUS

Figure 1:
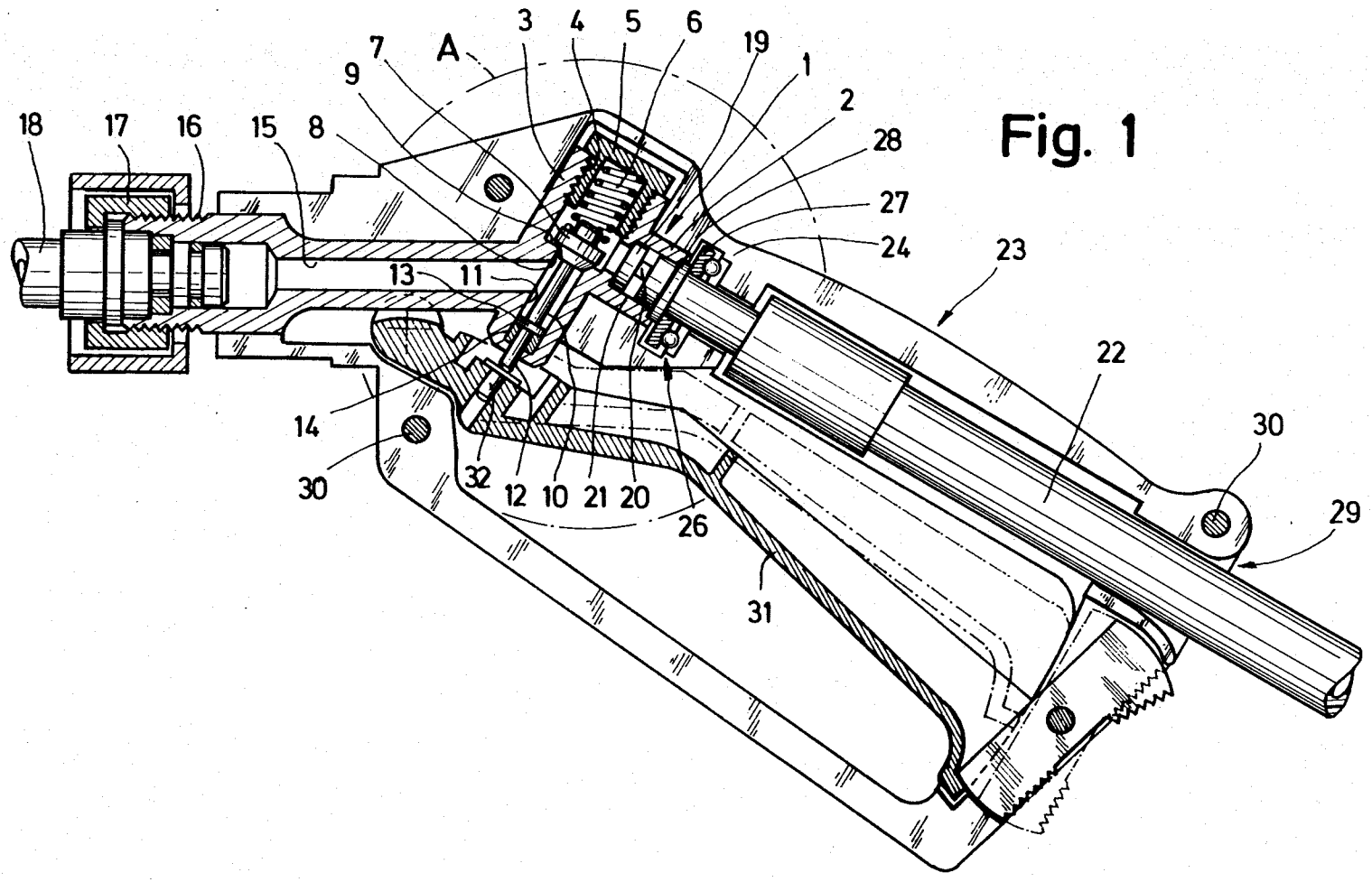

The invention relates to a high pressure washing apparatus with a hand-held spray pistol, with a flexible hose connected to it.

In known high pressure washing apparatus, the hand-held spray pistol has a metal connector with an internal or external thread for attachment of the flexible high pressure hose. Disadvantages of this arrangement are that the hose is not rotatable with respect to the spray handle body, and that this connection method requires several separate parts, and is costly. Furthermore, for hot water or steam operation, the metallic fixtures must be insulated against operator contact. Lastly, there is a risk of kinking of the high pressure hose at the transition region, so that normally a supplementary kinking-preventative sleeve is needed.

It is the task of the invention to develop a high pressure washing apparatus of this type in such a way that the spray handle and the high pressure hose can rotate with respect to one another.

This task is accomplished in a high pressure washing apparatus of the kind described above, in that for connection of the hose the spray pistol displays a barrel into which may be inserted a hose nipple attached to the hose end, and in the spray handle is provided a bearing surface against which rests a flange on the hose nipple, thereby preventing the hose nipple from pulling out of the barrel, with the bearing surface and/or the nipple flange surrounding the nipple in a ring form, allowing them to be rotated with respect to one another around the longitudinal axis of the hose nipple.

It is advantageous for the bearing surface and the flange to constitute parts of a ball bearing surrounding the hose nipple; in this way the hose and spray handle can rotate with respect to one another even when filled with washing fluid under high pressure.

It is also possible, however, for the bearing surface and flange together to constitute a sleeve bearing.

In a preferred embodiment of the invention, it is provided for the barrel and the bearing surface to be arranged within the spray handle, and for the spray handle to surround the end of the high pressure hose adjacent to the hose nipple, as protection against kinking and/or contact. The preferred embodiment of the invention has the great advantage that with hot water operation, hot contact points are protected from being touched. In addition, through such a configuration, the end of the high pressure hose near the hose nipple is itself introduced into the spray handle, so that no kinking can occur in this region.

It is especially advantageous for the end of the spray handle to open in a funnel shape in the area where the high pressure hose leaves it. In this way, kinking of the high pressure hose is effectively prevented in this area as well.

In a preferred embodiment of the invention, it is provided for the barrel to be part of a central assembly with a shutoff valve and a connectin for a sprayer tube, and for this assembly to be arranged between two housing sections of the spray handle, and for the bearing surface to be located on these housing sections. This arrangement makes it possible to insert the high pressure hose into the barrel before the assembly is seated between the two sections of the housing. Afterward the two housing sections are placed over this assembly from both sides, and fastened together. When this has been done, the high pressure hose bears against the respective bearing surfaces of the two sections of the housing, and cannot thereafter be pulled out of the barrel.

It is favorable for the housing sections to be made of plastic or plastic-coated metal, since in this way they offer an effective protection against touching the assembly, and against thereby being burned.

In a preferred embodiment of the invention, the housing sections are essentially symmetrically constructed halves. The assembly is preferably fixed in this housing in a form-locking manner; i.e. the position of the assembly with respect to the housing sections is defined solely by contact of the sections of the housing with opposite ends of the assembly. It is advantageous for the handle sections to surround the assembly completely, since in this way any touching of the assembly is securely prevented.

Figure 2:
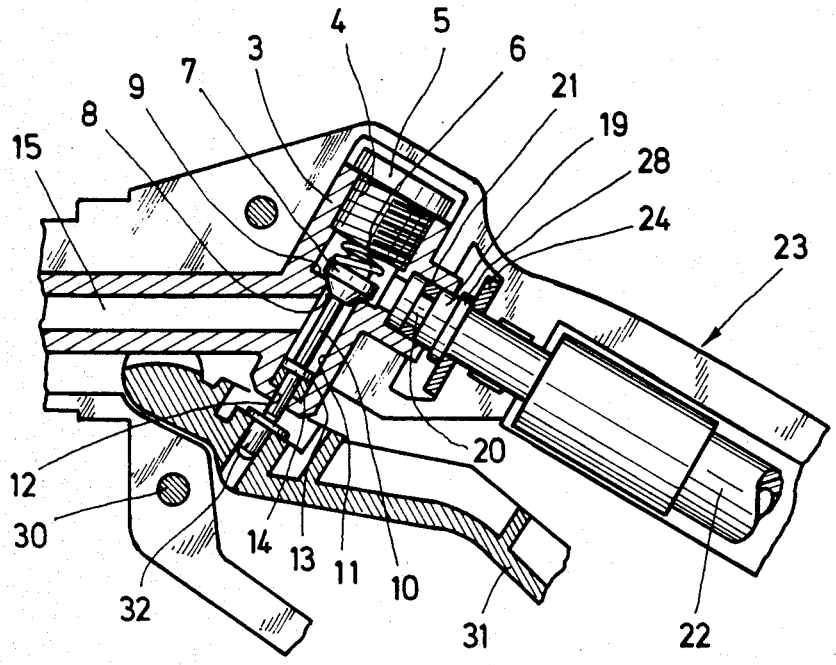

The following description of preferred forms of realization of the invention, in conjunction with the diagrams, serves for greater clarification. The diagrams show:

in FIG. 1, a longitudinal view of a spray handle with a rotatable hose connection, and in FIG. 2, a view corresponding to the area within the circle A of FIG. 1, in a modified form of realization of a spray handle.

The spray handle represented in FIG. 1 includes a central body 1 with a short tubular socket 2, which opens into a perpendicular tubular barrel 3. This tube 3 bears an internal thread 4, into which is screwed a plug 5. Bearing against the plug 5 is a spring 6, whose other end bears on a valve body 7, and presses it against an outlet 8 in a base 9 closing off the barrel 3. The rim of this outlet opening 8 represents a valve seat for the valve body 7, which is conical in this region.

The valve body 7 is connected to an actuating rod 10, which projects through the outlet 8, and is located in a hole 11 arranged in the extension of the barrel 3. The hole 11 is closed at its end opposite the outlet opening 8, and in this region displays an opening 12 through which the actuating rod 10 extends out of the body 1. The actuating rod 10, within the hole 11, is provided with a ring flange 13, which bears against an O-ring seal 14 surrounding the actuating rod 10. This O-ring forms a seal between the actuating rod 10 and the inner wall of the hole 11.

Branching off from the hole 11 is a connector duct 15, which bears at its end an external thread 16. Onto this external thread, a spray tube 18 is attached, by means of a retaining nut 17. This spray tube 18 leads to a spray nozzle, not shown in the drawing.

Inserted into the tubular socket 2 on the inlet side of the body 1, is a hose nipple 19, which bears an O-ring seal 21 in an annular slot 20. This seal lies tightly against the inner wall of the tubular socket 2, and seals between the hose nipple and the socket 2.

The hose nipple in turn is connected to the end of a flexible high pressure hose 22, which leads, in a manner not shown in the drawing, to the pressure-side outlet of the high pressure pump of a high pressure washing unit.

The described body 1, and the end of the high pressure hose 22 inserted into it, are embedded between two symmetrically formed housing sections 23, only one of which is represented in FIG. 1. This housing section, which is preferably made of plastic or a plastic-coated metal, has on its end toward the high pressure hose a number of recesses into which the body 1 and the end of the high pressure hose 2 can be inserted in a form-locking manner.

The two halves of the housing display a bearing surface 24, surrounding the hose nipple, which extends precisely perpendicular to the longitudinal axis of the hose nipple. This bearing surface 24 forms one cage of a ball bearing 26, against whose other cage 27 is supported a ring flange 28, formed as an integral part of the hose nipple 19. In this way, the hose nipple is secured within the socket 2 against being pulled out, as soon as the body and the high pressure hose have been placed between the two housing sections 23.

The end of the high pressure hose adjacent to the hose nipple is surrounded on all sides by the two housing sections, extending in funnel shape outward toward the exit from the housing formed by the two sections, so that the hose is guided to the outlet region 29 within the housing, and is protected by the funnel shape against kinking, in the outlet region.

The two symmetrical housing sections are connected to one another after application to the body, for example by means of rivets 30.

Between the two housing sections is also attached a pivotable actuating lever 31, which bears a pressure foot 32. By pivoting of the actuating lever 31, the pressure foot 32 can be pressed against the end of the actuating rod 10, so that by pivoting of the actuating lever 31, the actuating rod and thus the valve body 7 are pressed into the barrel 3, against the action of the spring 6, thus opening the outlet hole 8. Then the washing medium under pressure, conducted through the high pressure hose, can pass through the socket 2, the barrel 3, the valve opening 8, the hole 11, and the duct 15 to the spray tube 18.

To replace the hose, the two housing sections need only be separated from one another. Then the body 1 can be removed from the two housing sections, and the hose nipple can easily be removed from the socket 2, since the retaining action of the bearing surfaces 24 is absent.

Through the described connection of the nipple to the socket, there results a connection which is rotatable around the longitudinal axis of the nipple, wherein, using a ball bearing, rotation is possible even when the hose is filled with washing medium under pressure.

In the example of realization represented in FIG. 2, which is largely identical with FIG. 1, and in which corresponding parts bear the same reference numbers, instead of the ball bearing, a simple slide bearing 24 is provided, on which the ring flange 28 of the hose nipple is supported directly. This results in a sleeve bearing, which enables a rotation of the spray handle with respect to the high pressure hose at least when not filled with washing medium under pressure. By using low friction materials, a rotation can be performed even with the hose under pressure.

What is claimed is:

1. High pressure washing apparatus that can operate with hot water or steam comprising a spray handle having two mating housing sections formed of a plastic material, a central body located within the housing section having a socket and a connection for a spray tube, a shutoff valve disposed within said central body, a bearing surface formed at the interior of said housing sections, a flexible high pressure hose, a hose nipple secured on a end of the hose adjacent said spray handle and insertable into the socket, and a flange secured on said hose nipple, said housing section, when mated, replaceably capturing and supporting said hose nipple within said socket, and containing central body, said bearing surface and said flange, said flange being secured, in a sealed fashion, against the bearing surface and thereby blocked from pulling out of the socket, and said bearing surface and said flange surrounding said hose nipple being rotatable with respect to one another around the longitudinal axis of the hose nipple.

2. High pressure washing apparatus according to claim 1 wherein the bearing surface is part of a ball bearing against which the hose nipple bears.

3. High pressure washing apparatus according to claim 1 wherein the bearing surface and flange together form a sleeve bearing.

4. High pressure washing apparatus according to claim 1 wherein the socket and the bearing surface are contained within the spray handle, and the spray handle surrounds the end of the high pressure hose adjacent to the hose nipple as a protection against kinking and contact.

5. High pressure washing apparatus according to claim 4 wherein the spray handle is funnel-shaped in the area where the high pressure hose leaves it.

6. High pressure washing apparatus according to claim 1 wherein the housing sections are essentially symmetrical halves of the housing.

7. High pressure washing apparatus according to claim 1 wherein the body is fixed within the housing sections in a form-locking manner.

8. High pressure washing apparatus according to claim 1 wherein the housing sections completely surround the body.

* * * * *